US006981756B2

(12) United States Patent
Fredrickson et al.

(10) Patent No.: US 6,981,756 B2
(45) **Date of Patent: *Jan. 3, 2006**

(54) APPARATUS AND METHOD FOR PLACING FLUID DROPLETS ONTO AN OBJECT

(75) Inventors: Daniel J. Fredrickson, Camas, WA (US); Richard W Seaver, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 192 days.

This patent is subject to a terminal disclaimer.

(21) Appl. No.: 10/675,534

(22) Filed: Sep. 30, 2003

(65) Prior Publication Data

US 2004/0061746 A1 Apr. 1, 2004

Related U.S. Application Data

(63) Continuation of application No. 10/142,631, filed on May 8, 2002, now Pat. No. 6,669,325.

(51) Int. Cl.
*B41J 2/165* (2006.01)

(52) U.S. Cl. ..... 347/34; 347/32

(58) Field of Classification Search ..... 347/22, 347/20, 24, 29, 32, 33, 35, 34, 37
See application file for complete search history.

(56) References Cited

U.S. PATENT DOCUMENTS 6,669,325 B2 * 12/2003 Fredrickson et al. ..... 347/22

* cited by examiner

*Primary Examiner*—Shih-Wen Hsieh

(57) ABSTRACT

An inkjet carriage for holding an inkjet pen includes an airflow reducing member configured and positioned to at least partially block airflow between an inkjet ejection nozzle of a pen on the carriage and an object to be printed upon during carriage movement.

42 Claims, 4 Drawing Sheets

APPARATUS AND METHOD FOR PLACING FLUID DROPLETS ONTO AN OBJECT

CROSS-REFERENCE TO RELATED PATENT APPLICATIONS

The present application is a continuation application of application Ser. No. 10/142,631 now U.S. Pat. No. 6,669,325, filed May 8, 2002 by Fredrickson et al., entitled "Apparatus and Method of Placing Fluid Droplets onto an Object", priority from which is claimed under 35 U.S.C. § 120 and from which the full disclosure is hereby incorporated herein by reference.

BACKGROUND OF THE INVENTION

Inkjet printers are of various types including those on which one or more inkjet printheads, also known as pens, are mounted on a reciprocally moving so called scanning carriage, and others in which the pens may be mounted in a stationary position on a frame for so-called page wide printing. Scanning inkjet printers ordinarily have a pen servicing station located at some point on the path of travel of the pen carriage, typically to one side or the other of the print area, so that the scanning carriage and associated pens thereon can be moved to the service station for purging or "spitting", priming, wiping, capping or otherwise servicing the pen orifices. The servicing station may include pen wipers, a source of pen servicing fluid and pen caps, some or all of which may be mounted in a stationary position or on a sled or other moveable support to bring the pens to be serviced and the service station into and out of operating proximity to each other for servicing. Inkjet printers with stationary printheads or pens which also may require periodic servicing may employ such a sled or moveable support to bring the service station to the stationary pens when servicing of the pen orifices is required.

Particularly in high speed printing using large format printer/plotters, the pen carriage and associated pens may be moved at speeds of 30–60 inches per second or even higher. Close control of the pen to paper or other media spacing (PPS) can improve print quality. Swath height error (SHE) is the variation (i.e., in the Y-direction in FIG. 1) in the swath of ink that the pen prints onto the media. Variation in the swath height directly impacts print quality and is responsible for swath boundary banding print defects. Single pass printing is especially sensitive to boundary banding because errors cannot be corrected with shingling or masking techniques as carriage speeds have increased. Dynamic swath height errors due to aerodynamic effects have therefore become an increasing problem, especially during single pass bi-directional printing. Single pass printing and rapid carriage speeds are therefore used for rapid printing. The leading and trailing pens on the carriage are most affected by this aerodynamic phenomenon.

SUMMARY OF THE INVENTION

Disclosed herein is a method of placing fluid droplets onto an object. An airflow reducing means is positioned proximate the fluid ejection device in a first direction and the fluid ejection device and reducing means are moved in the first direction relative to the object with the airflow reducing means leading the fluid ejection device. The method includes moving a fluid ejection device in a first direction, reducing air flow between the fluid ejection device and the object with a member leading the fluid ejection device, and ejecting the fluid droplets onto the object.

DETAILED DESCRIPTION OF THE EXAMPLE EMBODIMENT

The invention has broad application to various types of fluid ejection devices such as inkjet pens and may also find application to medical devices, fuel injectors and other equipment in which droplets are to be forcefully ejected from a device such as a piezo-electric, thermal or any other fluid droplet ejector under controlled conditions. For convenience an embodiment of the invention will be described with reference to inkjet printers which typically use thermal or piezo-electric means to eject ink droplets through orifices of a pen nozzle onto media, such as paper or fabric, on which printing is to take place.

Figure 1:
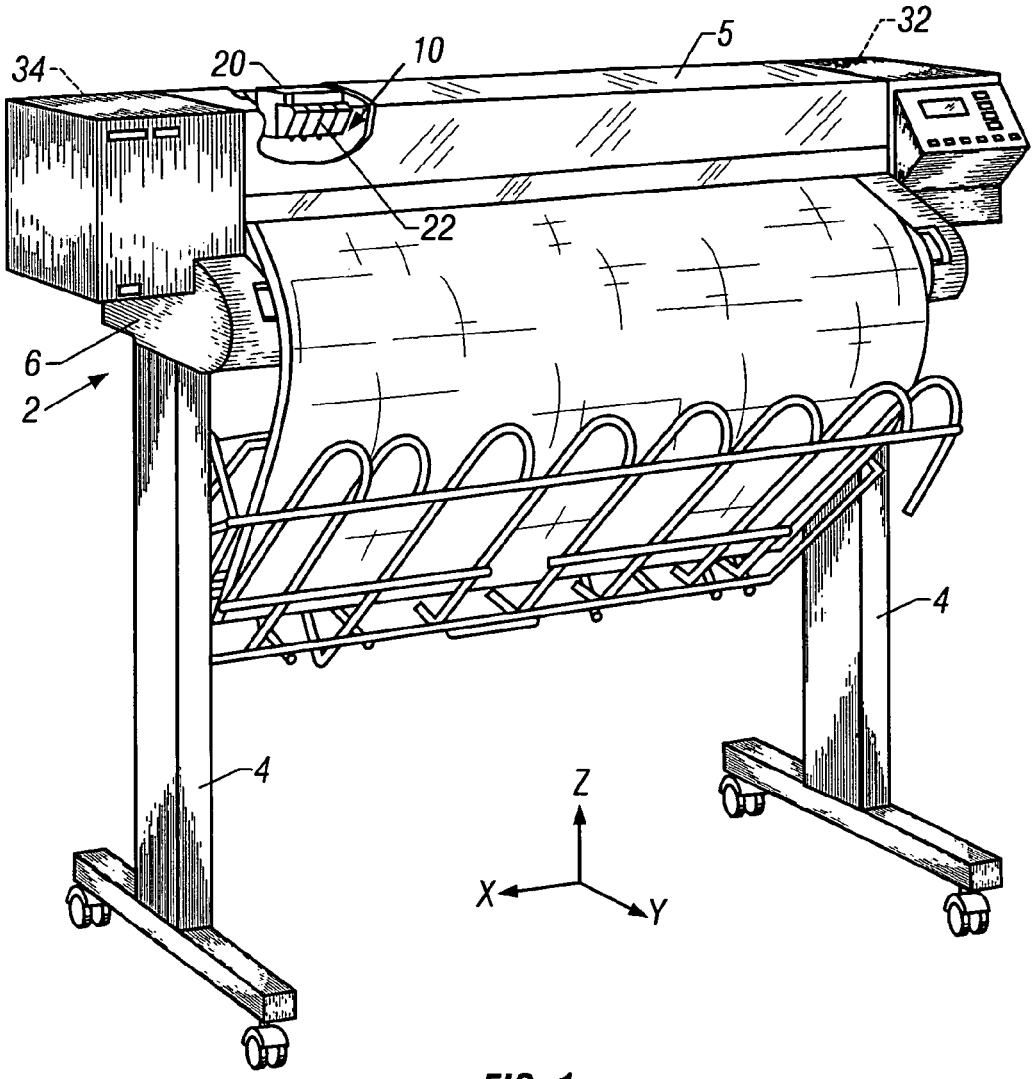
FIG. 1 is a perspective view of a wide format scanning inkjet printer/plotter as one example of a fluid ejection device in which an embodiment of the present invention may be used.

FIG. 1 is a perspective view of one form of an apparatus using fluid ejection technology, here shown as an inkjet printer/plotter mechanism having a chassis 2 supported by a pair of spaced apart legs 4 and a housing which includes an upper casing 5 and a generally arcuate cover 6 for containing a roll of print medium such as paper, velum, fabric or film. Although a large format printer/plotter is depicted in FIG. 1 by way of example, those skilled in the art will understand that this disclosure is applicable to other types of printers as well, such as desk top size printers, along with other fluid ejection devices such as medical devices, fuel injectors and other equipment in which droplets are forcefully ejected from a device. A printzone 10, extends transversely across the printer/plotter in the X-direction and has a reach extending in the Y-direction a relatively short distance usually about 2½–7 cm (about 1–3 inches) although this length is technically unlimited.

Figure 2:
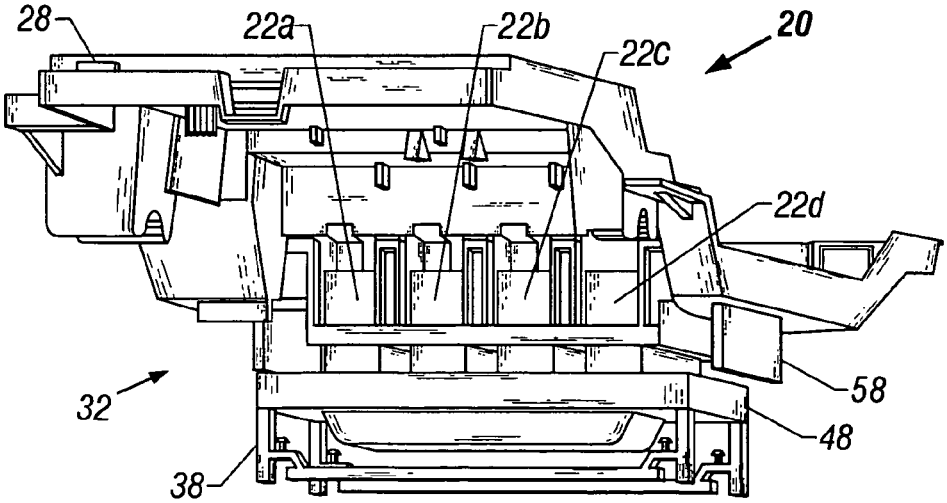
FIG. 2 is a perspective view of one form of a carriage which may be used to support one or more inkjet ink-ejecting pens, here shown with a service station capping or sealing the pens during a period of printing inactivity.
Figure 3:
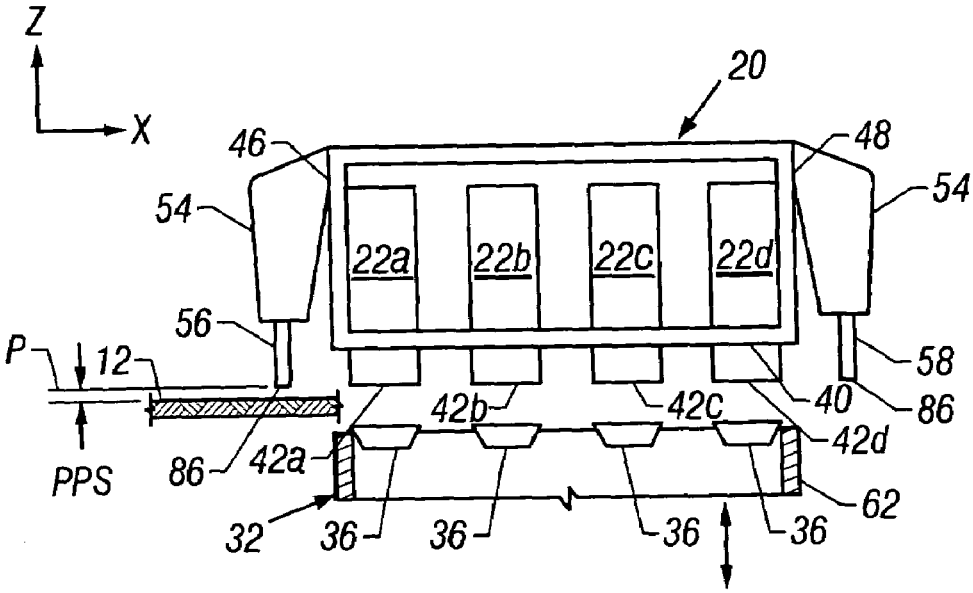
FIG. 3 is front elevation view of the carriage of FIG. 3.
Figure 4:
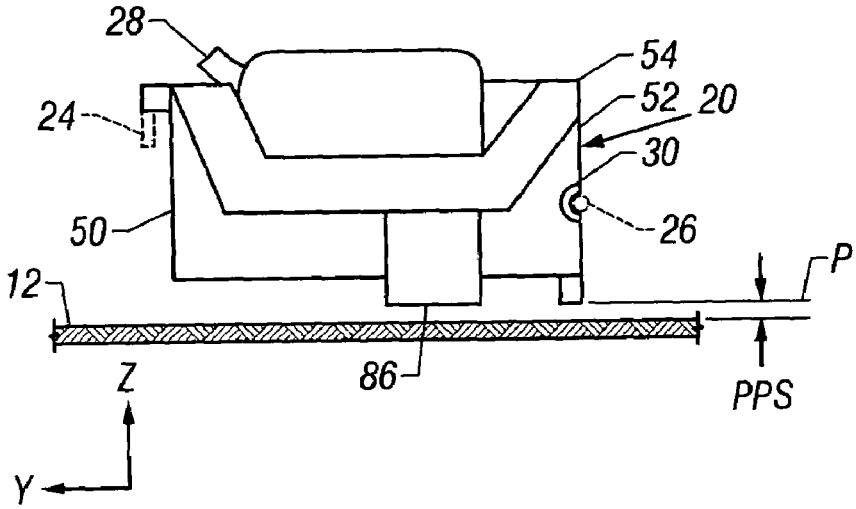
FIG. 4 is a side elevation view of the carriage of FIG. 3.

Referring to FIGS. 2–4, a carriage 20, which supports a plurality of ink ejecting cartridges or pens 22*a*–22*d* (only four are shown in the illustrated embodiment), is supported on the printer/plotter chassis 2 by guides 24, 26 shown in dashed lines in FIG. 4 which, in the illustrated embodiment, comprise a front guide rail 24 which engages a front carriage support 28 and a rear guide 26 shown in the form of a rod which engages a rear carriage support depicted in the illustrated embodiment as a bushing 30. The carriage is driven back and forth in the X-direction to print onto media intermittently moveable in the Y direction which is supported on a flat or curved platen 12 extending through the print zone 10. As seen in FIGS. 3 and 4, the spacing in the Z direction from the orifice nozzles of the pens 22 to paper or other media laying on the platen 12 labeled as the dimension "PPS". (PPS) is preferably closely controlled to optimize printing resolution.

In the exemplary type of printer depicted in FIG. 1, a pen service station 32 may be positioned laterally to one side or the other of the media path (at the right side of the printer 1 as shown) and a so-called offboard or "off-axis" ink supply station 34 may be provided at the other (left) side containing relatively large supplies of ink for replenishing ink used during printing from ink chambers in the carriage borne pens 22*a*–22*d*. The carriage 20 and pens mounted thereon therefore may be parked at the service station 32 so that fluid ejection orifices in the pen nozzles can be serviced by wiping, cleaning, spitting or priming as desired. Pen servicing equipment such as wipers (not shown) and caps 36 may be mounted on a moveable support sled 38 depicted partially in FIGS. 2 and 3 at the service station 32 so that the sled and servicing equipment may be moved toward and away from the carriage 20 and pens 22*a*–22*d* when parked for servicing and/or maintaining the pens in a moist condition during periods when the printer is not engaged in printing.

The carriage 20 as depicted in FIGS. 3 and 4 is preferably fabricated of plastic with a bottom portion preferably in the form of a frame 40 having separate apertures therein for reception of nozzle ends 42*a*–42*d* of the respective pens 22*a*–22*d*. Each of the nozzle ends 42*a*–42*d*, referred to herein generically by item number 42, comprises a series of fluid ejection nozzles 45 (see FIG. 6 in which the nozzles 45 are shown to a greatly enlarged scale) often arranged in a pair of linear arrays as shown. The pens 22*a*–22*d* may be positioned in individual stalls or receptacles in the carriage 20. The carriage 20 includes spaced sides 46, 48 (FIG. 3) and front and rear portions 50, 52 (FIG. 4) comprised of beams, walls or other structural members, the configuration of which will be varied as necessary from printer to printer.

Airflow reducing members, depicted in the form of deflectors 56, 58 to deflect and thus partially reduce the flow of air between the fluid ejection nozzles 45 and media or other target object, are provided preferably on the carriage 20 or other holder on which the fluid ejectors are supported, although it is possible that appropriately configured deflectors might be provided alternatively or additionally on the fluid ejectors themselves so long as spacing is provided between the deflectors 56, 58 and nozzles 45 to allow for capping or other servicing as necessary. The deflectors 56, 58 or other airflow reducing means may be separately fabricated parts suitably affixed to the frame 40 such as through bonding or various fasteners, or they may comprise tabs or other fairing configurations molded as integral parts of the carriage 20. In the depicted embodiment, the carriage includes a pair of holders 54 which space the deflectors 56, 58 outwardly in the X-direction from the sides 46, 48 of the carriage, and away from the outboard pens 22*a*, 22*d*. Accordingly, the fluid ejection nozzles 45 travel through a print zone during movement of said carriage, one of said deflectors 56, 58 being outside the print zone, i.e., located to one side of the print zone, when the carriage 20 reaches an end of its reciprocal movement. The deflectors 56, 58 are thus positioned so that the carriage 20 and pens mounted thereon can be moved for servicing into the service station 32 without interference with the various servicing modules such as pen caps and wipers when desired. The pens 22 are generally sealed by caps 36 when the printer is not being used, which prevents drying of the ink and clogging of the orifices in the nozzles 45. Other servicing modules (not shown) may also be present at the service station including pen wipers, primers and receptacles or "spittoons" for receiving ink purposely ejected or "spit" from the pens 22 at the service station to clean the nozzles.

The servicing modules present at the servicing station 32 may be mounted on the moveable frame and include the caps 36 as well as other servicing equipment previously described but not shown. FIG. 3 schematically shows part of the service station 32 which includes the a frame for holding servicing components mounted for movement toward and away from the pens 22 when the carriage 20 is parked in the service station so that the caps 36 may engage the orifice plate and surround the nozzles 45 to create a humid sealing chamber around the nozzles 45 As seen in FIG. 3, adequate clearance space is provided between the deflectors 56, 58 and the outboard pens 22*a*, 22*d* for the service station frame to have when the caps 36 cover the pen nozzles 45.

The deflectors 56, 58 are positioned on the carriage 20 preferably about one pen width (in the X-direction) outwardly away from the fluid ejection nozzles 45 of the outer pens 22*a* and 22*d* to ensure that the deflectors 56, 58 effectively reduce airflow near the pens 22 as the carriage travels through the printzone 10. Airflow reduction will of course be realized by other spacing of the deflectors 56, 58 from the nozzles 45. As seen in FIGS. 3 and 4, the nozzles 45 of the pens 22 typically occupy a common plane P and the deflectors 56, 58 preferably extend to and terminate in or near the same plane P, although in other implementations, the deflectors, 56, 58 may extend to terminate beyond or before plane P.

Figure 5:
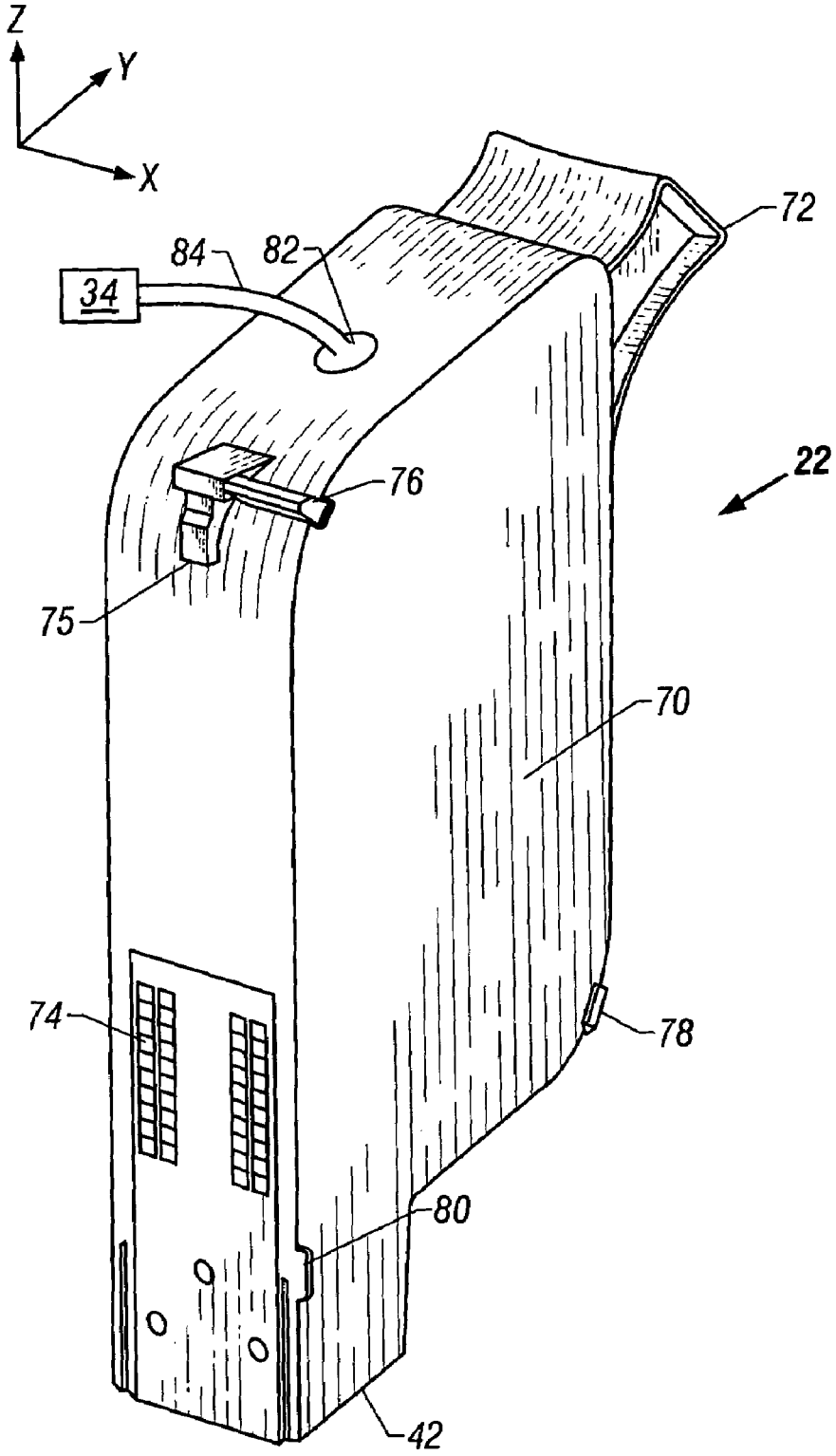
FIG. 5 is a perspective view of one form of a fluid ejection device, here shown as a pen cartridge.

Although the individual pens 22 need take no special configuration for use, one suitable embodiment of an inkjet pen 22 is shown in FIG. 5 in the form of a disposable inkjet cartridge having an ink reservoir 70, a nozzle end 42, a finger grip 72 for removing the cartridge from its individual receptacle in the carriage 20, an electrical interconnect 74 and various datum surfaces such as 75, 76, 78 and 80 for accurately positioning the pen 22 in its carriage receptacle. In larger scale printer/plotters in which a considerable amount of ink is used during the printing process, the individual pens 22 may include a refill port 82 which, during use of the printer, is used to intermittently or regularly refill the cartridge with ink from larger so-called off-board or "off-axis" ink supplies located at the ink supply station 34 (shown schematically in FIG. 5) via fluid conduits such as flexible plastic tubing 84. In smaller printer applications, the pens 22 comprise cartridges each containing sufficient ink for relatively long use and may not have a refill port 74. Such cartridges are usually disposed after use.

The deflectors 56, 58 are designed to reduce the detrimental aerodynamic effects on print quality, particularly swath height errors (SHE). The size, position and configuration of the deflectors 56, 58 will vary with the specific construction of the carriage 20 and pens 22. The deflectors are therefore appropriately sized, configured and positioned in a particular implementation to effectively deflect and reduce airflow which adversely affects the trajectory of ink droplets ejected from the fluid ejection device toward the media or other target onto which the droplets are to be precisely positioned. The deflectors 56,58 may be angled or pointed in the direction of movement to function as a plow and deflect air away from the leading one of the moving pens 22. The deflectors 56, 58, thus enhance the performance of fluid ejection devices comprised of one or more separate ejectors such as individual inkjet pens 22 which may be aligned in the X-direction of carriage movement.

Lower edges 59 of the deflectors 56, 58 extend (downwardly as shown in FIG. 3) to a position closely spaced from the media support platen 12 or other object onto which fluid droplets are to be ejected. As seen in FIG. 4, the lower boundary or edge of the deflectors 56, 58 is depicted as straight in the Y-direction although it will be appreciated that this is not essential since the platen 12 over which the media passes for printing may be curved instead of straight, so curved boundary edges for the deflectors 56, 58 might be preferable in this instance. Also, the lower edges 59 of the deflectors 56, 58 may be generally flat in the X-direction as seen in FIG. 3 or the edges 59 may be tapered, sharpened or rounded to minimize the adherence of ink or debris thereto, and to enhance their aerodynamic effect in reducing airflow between the fluid ejection device and the object onto which droplets are to be projected. Furthermore, while the illustrated defectors 56, 58 are shown as having generally planar outboard surfaces, in other implementations it may be preferable to configure a leading, outboard, exterior surface with an air-piercing contour to minimize drag from air-induced friction. Additionally, the deflectors 56, 58 may be rigid or may be purposely designed of resilient materials such as an elastomer to flex slightly during operation. Ink compatible elastomers such as those used to construct resilient components of the service station 32 such as the caps 36 may be used for this purpose.

Figure 6:
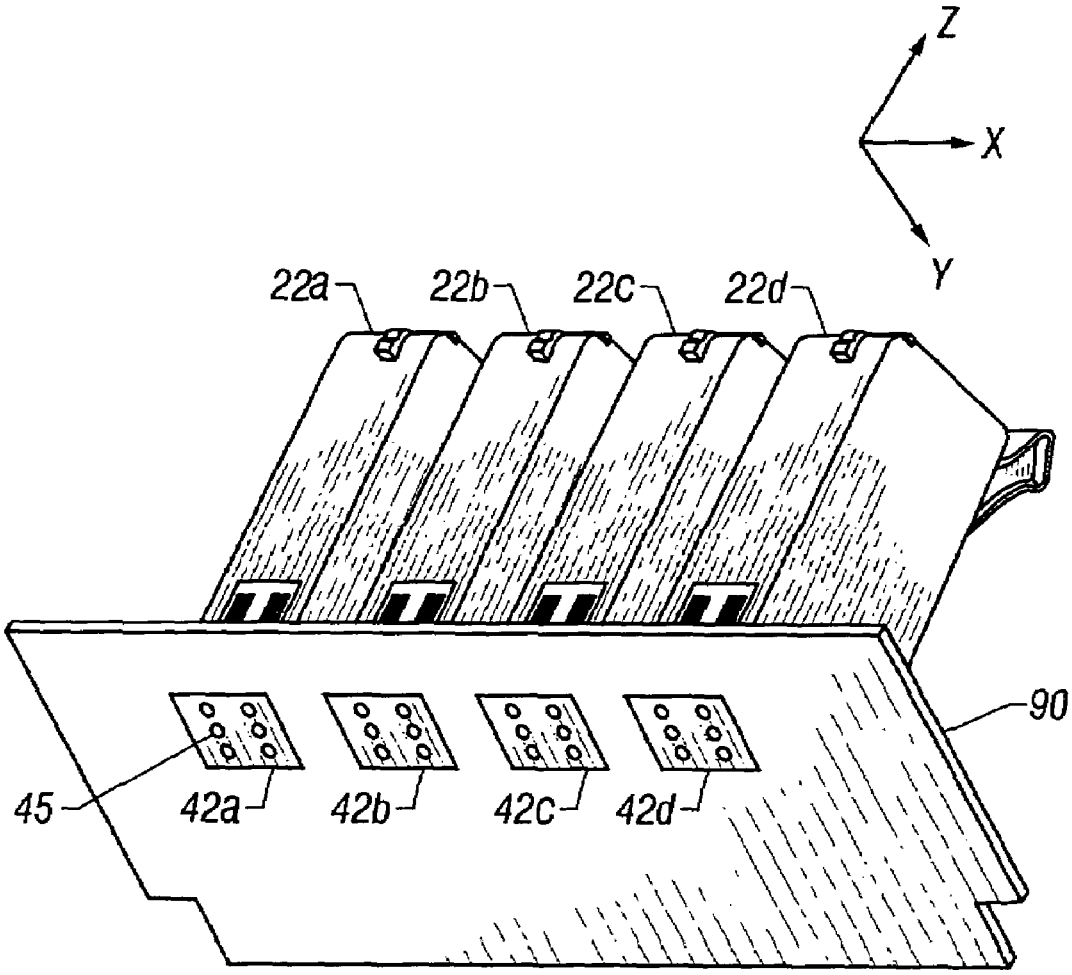
FIG. 6 is a schematic perspective of a carriage with an alternative embodiment of an airflow deflecting mechanism.

Although the airflow deflecting means are depicted in the example embodiments illustrated in FIGS. 2–4 as generally rectangular deflectors 56, 58, various other configurations of airflow deflectors can be readily envisioned including, for example, a fixed carriage skirt 90 as depicted schematically in FIG. 6 in a rectangular configuration. This and some other configurations may, however, undesirably enlarge the dimensions and weight of the carriage 20 and may physically interfere with the frame of the service station 32, caps 36, the chassis, the exterior casing 5 or with other service components. As compared with the broad surface area of the skirt 90 depicted in FIG. 6, it will be noted that the surface areas of the edges 59 of the deflectors 56, 58 of FIGS. 2–4 which extend generally parallel to the platen 12 are very small and thus accumulation of ink and fiber on the ends of the deflectors 56, 58 is minimized to reduce or completely eliminate the necessity to occasionally wipe or otherwise clean them.

It will be appreciated that although the edges 59 of the deflectors 56, 58 are depicted in the same plane as the nozzles of the pens, this also is not essential. Typically, the PPS is only about 1 mm and it is therefore presently believed that the edges 59 of the deflectors 56, 58 should be spaced approximately the same distance from the platen 12 as are the fluid ejection nozzles 45 of the pens 22.

In its broadest sense, the provision of deflectors to deflect and reduce airflow effects on droplet placement in inkjet printers is applicable not only to the bi-directional scanning printers having a moving carriage as described above, but is also applicable to rotary printers and other types of printers in which media is supported on a rapidly rotating drum or belt as it moves relative to inkjet pens and to other applications in which fluid droplets must be accurately positioned on an object moving relative to the fluid ejector or ejectors.

Persons skilled in the art will also appreciate that various additional modifications can be made in the example embodiments shown and described above and that the scope of protection is limited only by the scope of the claims which follow.

What is claimed is:

1. A method of placing fluid droplets onto an object, the method comprising:

moving a fluid ejection device including a carriage having an air flow reducing member and at least one fluid ejector carried by the carriage in a first direction;

reducing air flow between said fluid ejection device and said object with the member leading the at least one fluid ejector; and ejecting fluid droplets onto the object.

2. The method of claim 1, wherein said fluid ejection device is comprised of a plurality of fluid ejectors.

3. The method of claim 1, wherein:

moving said fluid ejection device relative to said object in a second direction;

reducing air flow between said fluid ejection device and said object with a member leading the fluid ejection device as said device moves in said second direction; and ejecting fluid droplets onto said object as said ejection device is moved in said second direction.

4. The method of claim 3, wherein said fluid ejection device is bi-directionally moved in a straight scanning line.

5. The method of claim 4, wherein said fluid ejector device includes nozzles arranged in a plane spaced from said object and said air flow reducing member has a boundary extending in said plane perpendicular to said line.

6. The method of claim 5, wherein said boundary is straight.

7. The method of claim 6, wherein said straight boundary is flat.

8. A method of forming an image on media with an inkjet printing mechanism which includes an inkjet pen carriage, comprising:

attaching an inkjet pen to the inkjet pen carriage;

moving the inkjet pen and an airflow deflector provided by the carriage proximate said inkjet pen on said carriage in a first direction, said deflector leading said pen to thereby reduce airflow between said relatively moving pen and media; and ejecting fluid droplets onto said media as said carriage and pen are moved in said first direction.

9. The method of claim 8, wherein said airflow deflector is on said carriage.

10. The method of claim 9, comprising ejecting fluid droplets from a plurality of pens on said carriage.

11. The method of claim 10, wherein:

said carriage is bi-directionally moved relative to said media and including positioning a second airflow deflector proximate said pens with said second deflector leading said pens during movement of said carriage in a second direction opposite to said first direction; and ejecting fluid droplets onto said media as said carriage and pens are moved in said second direction.

12. The method of claim 11, wherein said carriage is moved in a straight scanning line.

13. The method of claim 12, wherein said pens include nozzles arranged in a plane spaced from said media and at least one of said airflow deflectors has a boundary extending in said plane perpendicular to said line.

14. The method of claim 13, wherein said boundary is straight.

15. The method of claim 14, wherein said straight boundary is a flat end.

16. An inkjet pen carriage for holding an inkjet pen, the carriage comprising:

a first airflow reducing member configured and positioned to at least partially block flow of air between an ink ejection nozzle of a pen on said carriage and an object to be printed during carriage movement in a first direction.

17. The carriage of claim 16, further including a second airflow reducing member positioned to at least partially block flow of air between an ink ejection nozzle of a pen mounted on said carriage and said media during carriage movement in a second direction.

18. The carriage of claim 17, wherein said airflow reducing member comprises first and second deflectors.

19. The carriage of claim 18, wherein said deflectors are integrally formed on said carriage.

20. The carriage of claim 18, wherein said deflectors are affixed to said carriage.

21. The carriage of claim 18, wherein said carriage defines a plurality of receptacles for holding plural inkjet pens arranged along a line of carriage movement, a first one of said deflectors being positioned at one side of said carriage and a second one of said deflectors being positioned at a second side of said carriage whereby said deflectors at least partially block airflow to said pens during reciprocal motion of said carriage.

22. The carriage of claim 21, wherein said receptacles are configured to hold pens having fluid ejection nozzles arranged in a plane and said deflectors each have a boundary extending in said plane perpendicular to said line.

23. The carriage of claim 22, wherein said boundary is straight.

24. The carriage of claim 23, wherein said straight boundary is a flat end.

25. An inkjet printing mechanism comprising:

a reciprocally moveable pen carriage;

an inkjet pen having an inkjet ejection nozzle and mounted on said carriage; and a first airflow deflector coupled to the carriage and positioned proximate said nozzle to at least partially block flow of air between said nozzle and media on which printing is to take place during carriage movement in a first direction.

26. The printing mechanism of claim 25, wherein said deflector is mounted on said carriage.

27. The printing mechanism of claim 26, further including a second inkjet pen having a second ink ejection nozzle on said carriage and a second airflow deflector coupled to the carriage and positioned proximate said second nozzle to at least partially block flow of air between said second nozzle and said media during carriage movement in a second direction.

28. The printing mechanism of claim 27, wherein said first and second deflectors are integrally formed on said carriage.

29. The printing mechanism of claim 27, wherein said deflectors are affixed to said carriage.

30. The printing mechanism of claim 27, wherein said carriage defines a plurality of receptacles for holding inkjet pens arranged along a line of carriage movement, a plurality of said pens respectively mounted in said receptacles, a first one of said deflectors being positioned at one side of said carriage and a second one of said deflectors being positioned at a second side of said carriage whereby said deflectors at least partially block airflow to said pens during reciprocal motion of said carriage.

31. The printing mechanism of claim 30, wherein said nozzles are arranged in a plane and said deflectors each have a boundary extending in said plane.

32. The printing mechanism of claim 31, wherein said boundary is straight.

33. The printing mechanism of claim 32, wherein said straight boundary is a flat end.

34. The printing mechanism of claim 27, wherein said nozzles travel through a print zone during movement of said carriage, one of said deflectors being outside said print zone when said carriage reaches an end of reciprocal movement.

35. An inkjet carriage for holding an inkjet pen, the carriage comprising:

a first means for reducing airflow positioned to at least partially block flow of air between an ink ejection nozzle of a pen on said carriage and an object to be printed during carriage movement in a first direction.

36. An inkjet printing mechanism comprising:

a reciprocally moveable pen carriage;

an inkjet pen having an inkjet ejection nozzle and mounted on said carriage; and a first means coupled to the carriage for deflecting and at least partially blocking flow of air between said nozzle and media on which printing is to take place during carriage movement in a first direction.

37. A fluid ejection device comprising:

a reciprocally moveable carriage;

at least one fluid droplet ejector mounted on said carriage;

a support for an object onto which fluid droplets are to be ejected; and a deflector coupled to the carriage for deflecting airflow away from a trajectory of fluid droplets ejected from said ejector toward an object on said support.

38. The fluid ejection device of claim 37, further comprising a second deflector coupled to the carriage for deflecting airflow away from said trajectory, said deflectors being positioned on said carriage relative to said ejector to lead said ejector during each direction of movement of said carriage.

39. The fluid ejection device of claim 38, wherein said deflectors have boundaries which extend parallel to said support.

40. The fluid ejection device of claim 38, wherein said deflectors are flexible.

41. An inkjet printing mechanism comprising:

a movable fluid ejection device; and an airflow deflector coupled to the fluid ejection device to at least partially block the flow of air between the fluid ejection device and media being printed upon during movement of the fluid ejection device relative to the media, wherein the air flow deflector is flexible.

42. The printing mechanism of claim 41, wherein the fluid ejection device includes:

a carriage; and at least one fluid ejector carried by the carriage, wherein the airflow deflector is coupled to the carriage.

* * * * *